US005179997A

United States Patent [19]

Koul et al.

[11] Patent Number: 5,179,997

[45] Date of Patent: Jan. 19, 1993

[54] PROCESS FOR INSULATING MOLTEN STEEL DURING CONTINUOUS CASTING

[75] Inventors: Maharaj K. Koul, Pennington, N.J.; Franklin T. Whitaker, Philadelphia; Richard W. Paul, Wallingford, both of Pa.

[73] Assignee: Atlantic Metals Corporation, Philadelphia, Pa.

[21] Appl. No.: 758,736

[22] Filed: Sep. 12, 1991

[51] Int. Cl.[5] ..... B22D 11/00

[52] U.S. Cl. ..... 164/473; 164/56.1

[58] Field of Search ..... 164/472, 473, 56.1

[56] References Cited

U.S. PATENT DOCUMENTS 4,785,872 9/1988 Koul et al. .

FOREIGN PATENT DOCUMENTS 57-184563 11/1982 Japan ..... 164/473

2-142653 5/1990 Japan ..... 164/473

OTHER PUBLICATIONS

I. Jimbo, B. Ozturk, S. Feldbauer and A. W. Cramb, "Some Aspects of Chemical Phenomena in the Mold of a Continuous Slab Caster", 1991 *Steelmaking Conference Proceedings*, pp. 153 to 162 (1991).

*Primary Examiner*—Kuang Y. Lin

*Attorney, Agent, or Firm*—Ferrill, Logan, Johns & Blasko

[57] ABSTRACT

The present invention provides a basic slag for use to protect molten steel in a tundish during continuous casting processes. The preferred slag of the present invention comprises a combination of CaO, MgO, $Al_2O_3$, and $TiO_2$. The resulting tundish covering has exceptional insulation, protective and $Al_2O_3$ absorptive properties, while avoiding operational problems encountered with previous basic tundish slags, such as crusting and refractory erosion.

4 Claims, No Drawings

PROCESS FOR INSULATING MOLTEN STEEL DURING CONTINUOUS CASTING

BACKGROUND OF THE INVENTION

1. Field of the Invention

The present invention relates to compositions used to cover, protect and insulate molten steel in a tundish during continuous casting of steel and the methods of using such compositions.

2. Background of the Prior Art

In continuous casting of molten steel, a tundish acts as a reservoir of molten steel between a ladle and caster in order to provide a continuous supply of molten steel into a mold. In a sequence casting procedure, anywhere from four to fifteen ladles of steel are continuously cast in a sequence. Molten steel from the ladle is poured into the tundish through a shroud and steel from the tundish is poured into one or more molds with a SEN tube. Fluid flow through the tundish is directed using dams, weirs, and baffles in such a way as to float out inclusions to the top and collect clean steel to flow into the mold.

In the past, an insulating layer of burnt rice hull ash (carbon and $SiO_2$) was used to insulate the molten steel. This is a cheap way to insulate the steel in the tundish, but produces less than fully satisfactory steel and is often environmentally disruptive. With increasing need for cleaner steel and a safer working environment, slag producing tundish powders have been introduced. These powders, such as Atlantic Metal Corporation's TUNDOLITE® TU920, comprise primarily carbon and aluminum silicate ($Al_2O_3$-$SiO_2$) and are effective in preventing the re-oxidation of steel in the tundish and are environmentally clean. Unfortunately, these compositions do not have the ability to absorb large quantities of $Al_2O_3$ and do not insulate well.

In order to meet continuously increasing demands for high quality steel, recent investigations have centered on use of basic tundish powders with high $CaO+MgO/SiO_2$ ratios. Although these powders have the ability to absorb $Al_2O_3$, they have other production problems, such as crust formation that prevents free operation of tundish during sequence casting, and severe erosion of $Al_2O_3$/graphite SEN tubes.

To attempt to solve some of these problems, applicant investigated using calcium aluminate ($CaO$-$MgO$-$Al_2O_3$) slag chemistries. These slags provided a basic slag cover but could not absorb large quantities of $Al_2O_3$ without forming a crust and causing operational problems during sequence casting. This reaction is believed to be a function of the amount of aluminum oxide absorbed in the slag causing a increase in the melting temperature of the slag.

Accordingly, it is a primary object of the present invention to provide a cover for use in continuous casting of molten steel which effectively provides insulation of molten steel in the tundish, absorbs inclusions floating on top of the steel, protects the steel from re-oxidation, contamination and crusting, and resists wear on continuous casting refractories.

It is a further object of the present invention to provide such a cover for molten steel which comprises a basic tundish powder having the ability to absorb $Al_2O_3$ without forming a crust due to increased melting point.

It is an additional object of the present invention to provide such a cover for molten steel which improves the cleanliness of steel without adversely affecting continuous casting operation.

It is another object of the present invention to provide such a cover for molten steel which delivers the above benefits while being simple to apply in the continuous casting process and relatively inexpensive to produce.

These and other objects of the present invention will become evident from review of the following specification.

SUMMARY OF THE INVENTION

The present invention provides a composition for use in covering and protecting molten steel in a tundish during continuous casting processes.

The composition of the present invention comprises a combination of $CaO$, $MgO$, $Al_2O_3$, and a reactive metal oxide. In the preferred embodiment, $TiO_2$ is employed as the reactive metal oxide in a percentage by weight of 3 to 10%. The resulting tundish powder may be applied to molten steel in a tundish in any accepted manner.

The composition of the present invention forms a basic slag with exceptional characteristics for insulating and protecting. Moreover, the composition of the present invention has a strong affinity for $Al_2O_3$, but avoids the tendency to form a crust upon absorption of high quantities of alumina. Finally, unlike some previous basic tundish powders, tests have demonstrated that the basic composition of the present invention does not tend to attack steel making refractories, such as SEN tubes and tundish lining.

DETAILED DESCRIPTION OF THE INVENTION

The present invention provides a composition for forming a protective slag over molten steel in a tundish during a continuous casting process.

As is known, the tundish comprises a refractory lined basin through which molten steel passes between a ladle and a mold in a continuous casting procedure. The tundish serves as a reservoir for the molten steel prior to pouring into one or more molds while also providing a venue for employing various dams, weirs, and baffles to separate various unwanted inclusions out of the steel.

In order to acquire high quality steel, it is particularly important that excess cooling and re-oxidation of the steel does not occur while it is in the tundish. Additionally, it is desirable to provide a chemical media through which unwanted inclusions, such as alumina ($Al_2O_3$), can be removed from the molten steel.

As has been discussed above, various compounds have been employed to accomplish insulation and protective functions in the past. Acid compositions containing $SiO_2$ are less effective at preventing re-oxidation, are relatively poor insulators, and are ineffective at absorbing large quantities of alumina. Basic composition using high ratios of $CaO+MgO/SiO_2$ are more effective in these respects, but tend to cause severe erosion of $Al_2O_3$/graphite SEN tubes. Another major problem with these previous basic slags is that their melting and crystallization temperatures tend to increase upon absorption of high quantities of $Al_2O_3$. If these critical temperatures of the slag change too much, a crust will form over the tundish, aborting the casting process.

A number of widely employed tundish covers employ aluminum silicate compositions. One such composition is marketed by Atlantic Metals Corporation under the trademark TUNDOLITE® TU920. This product has a typical chemistry of:

| Constituent | Typical (wt %) |
|---|---|
| CaO | 8 |
| $Al_2O_3$ | 10 |
| MgO | 11 |
| $SiO_2$ | 61 |
| $Fe_2O_3$ | 4 |

As was noted above, this product functions reasonably well, but is not particularly insulative and, due to the high concentration of silica in this composition, it is quite poor at absorbing $Al_2O_3$. Additionally, with certain grades of steel this product can cause re-oxidation.

A far more effective slag which applicant has tested under the designation TU870 utilizes a basic composition of calcium aluminate. This product has a typical chemistry as follows:

| Constituent | Typical (wt %) | Range (wt %) |
|---|---|---|
| CaO | 43 | 41–45 |
| $Al_2O_3$ | 30 | 28–32 |
| MgO | 25 | 23–27 |
| $SiO_2$ | 1 | 1.0 max. |

This powder has typical fusions characteristics as follows:

| Characteristic | Typical | Range |
|---|---|---|
| Initial Deformation Temp. | 1350° C. | 1320–1370° C. |
| Softening Temp. | 1365 | 1345–1385 |
| Hemispherical Temp. | 1385 | 1365–1405 |
| Fluidity Temp. | 1440 | 1420–1460. |

Although TU870 functions much better than silica-based compositions (such as TU920) and available basic compositions, it suffers the same primary drawback as these other compositions—it is not effective at absorbing large quantities of $Al_2O_3$. Like other available basic compositions, TU870 is unable to absorb large quantities of alumina without having its melting and crystallization temperatures raised significantly to form a crust.

In order to attempt to address this problem, applicant examined using various CaO/MgO compositions employing reactive metal oxides (such as $LiO_2$, $SrO_2$, $TiO_2$, $Na_2O$, BaO) and various amounts of $SiO_2$ and carbon. Through extensive experimentation applicant discovered that the proper combinations of these components produced a basic tundish powder which will absorb significant amounts of $Al_2O_3$ without crusting.

It has been determined that the composition should comprise the following components:

| Constituent | Range | Preferred Range |
|---|---|---|
| CaO | 30–60% wt | 37–45% wt |
| MgO | 5–25 | 15–20 |
| $Al_2O_3$ | 10–30 | 22–27 |
| Reactive Metal Oxide: | | |
| $SrO_2$ | 1–5 | 3–5 |
| BaO | 1–5 | 3–5 |
| $TiO_2$ | 3–10 | 4–6 |
| $LiO_2$ | 1–10 | 4–6 |
| $Na_2O$ | 0–10 | 0.5–1 |
| Carbon | 0–20 | 5–10 |

-continued

| Constituent | Range | Preferred Range |
|---|---|---|
| $SiO_2$ | 1–15 | 4–7 |
| $Fe_2O_3$ | 0–2 | 0.5–1 |
| $K_2O$ | 0–10 | 0.5–1 |

Taking into account reactivity as well as availability and cost, titanium dioxide ($TiO_2$) is believed to be the most effective reactive metal oxide for use in the present invention. It has proven to be quite effective when employed up to a percentage weight of 10% and as low of a percentage as 3%. Keeping cost in consideration, the preferred range is 4–6%, with 5% being considered the optimum.

A tundish powder of the present invention is formed by mixing high purity oxides minerals and chemicals in a batch system with weighing tolerances +/−1 lb. A high intensity blender is utilized with a PIN intensifier bar at 3500 ft/min PIN tip speed. This intense blending is required for consistent chemistries and powder properties to mix all ingredients intimately. Thorough mixing is especially important with regard to the carbon materials and the reactive metal oxides.

In use, the above composition may be placed on the molten steel in the tundish in any accepted manner. It is preferred to apply the powder in polyethylene bags (typically 25 lbs.) to strategically distribute the powder in the desired areas at the proper amount. The tundish is normally comprised of distinct regions separated by baffles with ports for steel flow control. The region into which the steel enters the tundish is normally termed the "pour box" and is the region where the slag must absorb the highest level of oxides, such as alumina, without crusting. A continuous application to maintain a powdery cover is required in all regions to provide insulation, absorb inclusions, and prevent crusting. Typically, the powder is distributed at a rate of one pound of powder for every ton of molten steel in the tundish.

The following represent examples of how the composition of the present invention may be made and used.

EXAMPLE 1

A composition of tundish powder was formed employing the following percentages:

| | |
|---|---|
| CaO | 40% |
| MgO | 18 |
| $Al_2O_3$ | 24 |
| $TiO_2$ | 4 |
| $SiO_2$ | 5 |
| $Fe_2O_3$ | 0.5 |
| Carbon | 8.0 |
| $Na_2O + K_2O$ | 1.5 |
| $H_2O$ @ 700° C. | 1 |

This composition was mixed in the manner described above. In testing, this composition proved to have a softening temperature of 1285° C., a hemispherical temperature of 1300° C., and a fluidity temperature of 1350° C. The crystallization temperature was measured at 1250° C.

When applied to molten steel in a tundish in the manner described above, this composition provided exceptional insulation characteristics. Moreover, this composition effectively avoided re-oxidation of the molten steel. With regard to absorption of alumina, subsequent tests demonstrated that 10% of $Al_2O_3$ was absorbed by the slag while producing no crusting at a steel temperature of at least 1535° C. Finally, inspection after testing showed no damage or abnormal wear to the continuous casting equipment, including the SEN tubes.

When compared to test results of TU870, this composition proved to be far less likely to solidify. By way of example, at temperature of 1535° C. slag without $TiO_2$ tends to begin crusting at an alumina absorption of 5%. By contrast, the slag of Example 1 showed no solidification with alumina absorptions exceeding 10%. Further it is important to note that, whereas crystallization temperature of TU870 is believed to increase with the absorption of alumina (its crystallization temperature is too high to measure on applicants' equipment), the crystallization temperature of the powder of Example 1 actually decreases upon absorption of $Al_2O_3$ (with typical melting temperature of 1300° C. and crystallization temperature of 1250° C.). A 10% alumina absorption decreases the crystallization temperature by 30° C. to 1220° C.

EXAMPLE 2

A composition of tundish powder was formed employing the following percentages:

| | |
|---|---|
| CaO | 42.0% |
| MgO | 5.5 |
| $Al_2O_3$ | 9.5 |
| $TiO_2$ | 8.0 |
| $SiO_2$ | 12.0 |
| F | 4.0 |
| Carbon (free) | 7.5 |
| Carbon (total) | 8.8 |
| $Na_2O$ | 6.0 |

This composition was mixed in the manner described above. In testing, this composition proved to have a softening temperature of 1290° C., a hemispherical temperature of 1300° C., and a fluidity temperature of 1320° C.

Although full tests results on this mixture are still incomplete, preliminary data indicate that this powder will perform equally as well as the composition of Example 1, above.

EXAMPLE 3

A composition of tundish powder was formed employing the following percentages:

| | |
|---|---|
| CaO | 42% |
| MgO | 10 |
| $Al_2O_3$ | 15 |
| $TiO_2$ | 1 |
| $SiO_2$ | 11 |
| $Fe_2O_3$ | 1 |
| Carbon | 17 |
| $Na_2O$ | 0.3 |
| $K_2O$ | 0.5 |

This composition was mixed in the manner described above. In testing, this composition proved to have a softening temperature of 1410° C., a hemispherical temperature of 1420° C., and a fluidity temperature of 1425° C. The crystallization temperature was measured at 1250° C.

This mixture has only been tested in conjunction with silicon killed steel, with very low alumina content. Although this composition performed very well in that context, it is believed that the relatively low reactive metal content may result in some crusting problems if it is employed with a steel with high alumina concentrations.

EXAMPLE 4

A composition of tundish powder was formed employing the following percentages:

| | |
|---|---|
| CaO | 40% |
| MgO | 22 |
| $Al_2O_3$ | 28 |
| $TiO_2$ | 5 |
| $SiO_2$ | 1.5 |
| $Fe_2O_3$ | 0.5 |
| Carbon | 1.6 |
| $Li_2O$ | 4 |

This composition was mixed in the manner described above. In testing, this composition proved to have a softening temperature of 1300° C., a hemispherical temperature of 1320° C. and a fluidity temperature of 1340° C. The crystallization temperature was measured at 1225° C. This composition is essentially the TU 870, as previously described, with the addition of reactive oxides $TiO_2$ and $Li_2O$. Whereas previous testing of the TU 870 exhibited crusting in the tundish, it is expected that the addition of the reactive oxides to suppress the softening, hemispherical and fluidity temperatures, and, especially, the crystallization temperature, will result in no crusting problems when employed with steel and alumina absorption is required.

With regard to insulation properties, the compositions made in accordance with the present invention are demonstrably better than previous tundish powders. Examples of typical insulation properties are set out below:

| Product | Theoretical 'K' ($J/M^3KS$) | Slope ($J/M^2S$) | Integral ($J/M^2$) $\times 10^7$ |
|---|---|---|---|
| Rice Hulls | 18.82 | 6714 | 2.658 |
| TUNDOLITE TU920 | 27.38 | 10473 | 4.498 |
| TU870 | 24.22 | 9379 | 4.467 |
| Examples 1&2 | 16.21 | 4155 | 2.585 |
| Example 3 | 13.23 | 4997 | 2.869 |

As the above examples demonstrate, the present invention has proven to be a highly effective tundish covering. It provides all desired insulation and protective characteristics, while being extremely effective at removing unwanted inclusions such as $Al_2O_3$ without detrimentally increasing the melting point of the slag. Finally, refractory damage is vastly reduced over previous basic tundish slag compositions.

Although particular embodiments of the present invention are disclosed herein, it is not intended to limit the invention to such a disclosure and changes and modifications may be incorporated and embodied within the scope of the following claims.

What is claimed is:

1. In a process for producing high quality steel through a continuous casting process, said process including pouring molten steel from a ladle into a tundish and then into a mold, wherein an slag is provided on top of the molten steel in the tundish to absorb impurities and to help insulate the molten steel therein, the improvement which comprises providing a basic slag which comprises a combination of CaO, MgO, $Al_2O_3$, and a reactive metal oxide selected from the group consisting of $Li_2O$, $SrO_2$, $TiO_2$, $Na_2O$, BaO, wherein the composition contains $SiO_2$ in an amount less than 15% by weight, wherein the slag maintains a melting and crystallization temperature of at least 1450° C. while absorbing and retaining at least 10% by weight $Al_2O_3$ therein;

spreading the slag over the molten steel in the tundish while maintaining the temperature of the molten steel at least at 1535° to maintain the fluidity of the slag; and retaining the molten steel in the tundish for a sufficient period of time to provide absorption of all excess $Al_2O_3$ from the molten steel into the slag.

2. The process of claim 1 wherein the reactive metal oxide comprises $TiO_2$.

3. The process of claim 3 wherein the percentage by weight of the components comprise

| | |
|---|---|
| CaO | 37–45% |
| MgO | 15–20 |
| $Al_2O_3$ | 22–27 |
| $TiO_2$ | 4–6 |
| Other components | 0–22. |

4. The process of claim 3 wherein the other components include at least one chemical selected from the group comprising carbon, $SiO_2$, $Na_2O$, $Fe_2O_3$, and $K_2O$.

* * * * *